US005954017A

United States Patent [19]

Federowicz

[11] Patent Number: 5,954,017

[45] **Date of Patent: *Sep. 21, 1999**

[54] ENGINE HAVING A ROTARY BLOCK

[76] Inventor: John S. Federowicz, 568 Browns Rd., Storrs, Conn. 06268

[ * ] Notice: This patent issued on a continued prosecution application filed under 37 CFR 1.53(d), and is subject to the twenty year patent term provisions of 35 U.S.C. 154(a)(2).

[21] Appl. No.: 08/916,382

[22] Filed: Aug. 22, 1997

Related U.S. Application Data

[60] Provisional application No. 60/029,015, Aug. 27, 1996.

[51] Int. Cl.[6] ..... F02B 57/00

[52] U.S. Cl. ..... 123/44 R; 91/491; 123/44 E

[58] Field of Search ..... 123/44 D, 44 E

[56] References Cited

U.S. PATENT DOCUMENTS

| | | | |
|---|---|---|---|
| 1,157,811 | 10/1915 | Shannon | 123/44 D |
| 1,742,706 | 1/1930 | Hermann | 123/44 R |
| 5,123,394 | 6/1992 | Ogren | 123/44 D |

FOREIGN PATENT DOCUMENTS

| | | | |
|---|---|---|---|
| 4003571 | 5/1991 | Germany | 123/44 D |
| 19666 | of 1911 | United Kingdom | 123/44 D |

*Primary Examiner*—Michael Koczo
*Attorney, Agent, or Firm*—John H. Crozier

[57] ABSTRACT

In a preferred embodiment, an engine, including: a housing having a cylindrical inner surface; a first circular block rotatably disposed within the housing and coaxial therewith, the first circular block having its outer surface circumjacent the inner surface; at least one first cylinder radially defined in the first circular block, the at least one first cylinder having its upper, open end disposed at the outer surface; at least one piston disposed in the at least one first cylinder for reciprocating motion therein; at least two inlet chambers defined in the housing and connected to a source of inlet gas to introduce inlet gas into the at least one first cylinder as the open end passes one of the at least two inlet chambers; at least two outlet chambers defined in the housing to permit outlet gas to exit the at least one first cylinder as the open end passes one of the at least two inlet chambers; and means to cause the first circular block to rotate as a result of a power stroke of the at least one piston.

5 Claims, 6 Drawing Sheets

ENGINE HAVING A ROTARY BLOCK

CROSS-REFERENCE TO RELATED APPLICATION

The benefit is claimed of the filing date of U.S. Provisional Application No. 60/025,015, filed Aug. 27, 1996.

BACKGROUND OF THE INVENTION

1. Field of the Invention

The present invention relates to engines generally and, more particularly, but not by way of limitation, to a novel engine which has a rotary block.

2. Background Art

A conventional engine has a block which is stationary with respect to the system in which it is installed, the block having defined therein one or more cylinders each containing a piston which reciprocates in the cylinder and supplies power to, typically, a crankshaft. The motive power for an engine may be provided by internal combustion, steam, or compressed gas, for example.

Such an engine usually has a relatively high size-to-power ratio and is relatively complicated in terms of the numbers of parts, the latter factor making such an engine relatively expensive and complicated to manufacture and repair. Another limitation of a conventional engine is that a piston can provide no more than one power stoke per revolution of the crankshaft.

Accordingly, it is a principal object of the present invention to provide an engine that is built of few parts.

It is a further object of the invention to provide such an engine that is easily and economically constructed and repaired.

It is an additional object of the invention to provide such an engine that has a relatively low size-to-power ratio.

It is another object of the invention to provide such an engine in which a piston can have more than one power stroke per revolution of an output shaft.

Other objects of the present invention, as well as particular features, elements, and advantages thereof, will be elucidated in, or be apparent from, the following description and the accompanying drawing figures.

SUMMARY OF THE INVENTION

The present invention achieves the above objects, among others, by providing, in a preferred embodiment, an engine, comprising: a housing having a cylindrical inner surface; a first circular block rotatably disposed within said housing and coaxial therewith, said first circular block having its outer surface circumjacent said inner surface; at least one first cylinder radially defined in said first circular block, said at least one first cylinder having its upper, open end disposed at said outer surface; at least one piston disposed in said at least one first cylinder for reciprocating motion therein; at least two inlet chambers defined in said housing and connected to a source of inlet gas to introduce inlet gas into said at least one first cylinder as said open end passes one of said at least two inlet chambers; at least two outlet chambers defined in said housing to permit outlet gas to exit said at least one first cylinder as said open end passes one of said at least two inlet chambers; and means to cause said first circular block to rotate as a result of a power stroke of said at least one piston.

BRIEF DESCRIPTION OF THE DRAWING

Understanding of the present invention and the various aspects thereof will be facilitated by reference to the accompanying drawing figures, submitted for purposes of illustration only and not intended to define the scope of the invention, on which.

DETAILED DESCRIPTION OF THE PREFERRED EMBODIMENTS

Figure 2:
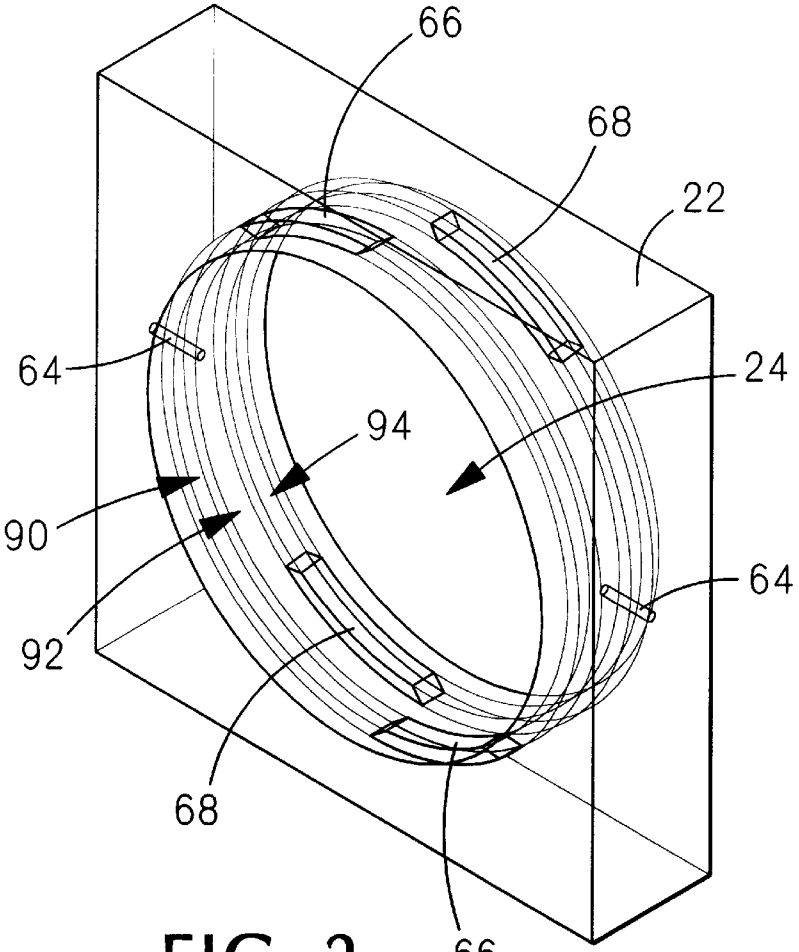
FIG. 2 an isometric view of the housing of the motor.

Reference should now be made to the drawing figures, on which similar or identical elements are given consistent identifying numerals throughout the various figures, and on which parenthetical references to figure numbers direct the reader to the view(s) on which the element(s) being described is (are) best seen, although the element(s) may be seen also on other views.

Figure 1:
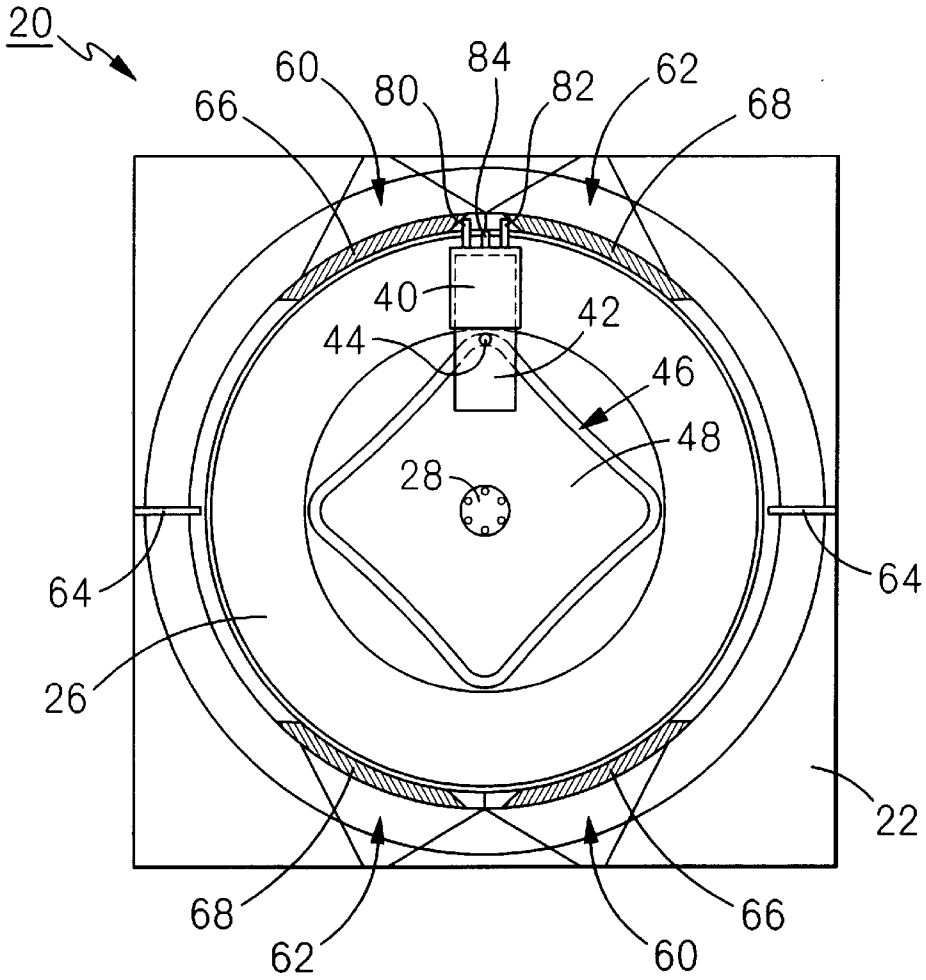
FIG. 1 is a side elevational view, partially cutaway, of an engine constructed according to the present invention.
Figure 3:
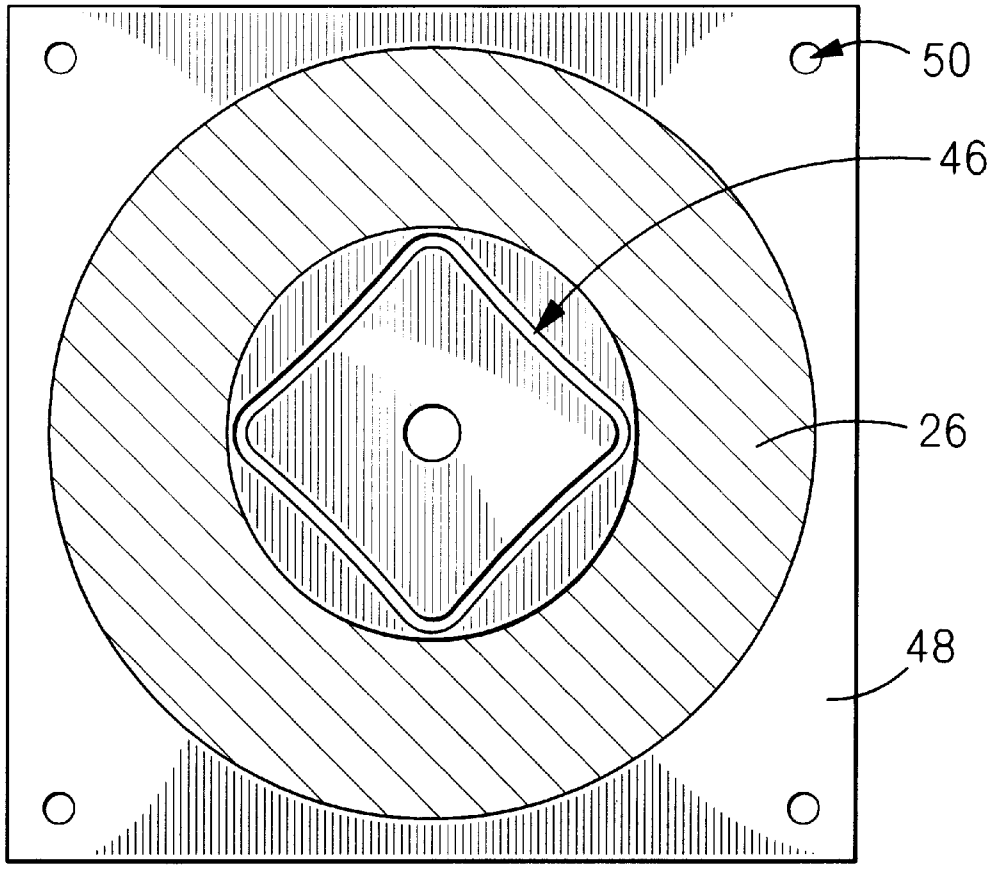
FIG. 3 is a side elevational view, partially in cross-section, of the rotary block of the motor together with one end plate.

Reference should first be made to FIGS. 1–3 together for an understanding of the construction and arrangement of the major elements of the motor of the present invention, the motor being indicated generally by the reference numeral 20. Motor 20 includes a stationary housing 22 (FIG. 2) having a circular opening 24 defined therethrough in which opening is disposed an annular rotary block 26 (FIG. 1) which is connected to an output shaft 28 through suitable supporting and connecting means (not shown). A cylinder 40 is radially defined in rotary block 26 in which cylinder is disposed a piston 42 for movement back and forth in the cylinder. A piston pin 44 extends through the walls of piston 42 and the ends of the piston pin are inserted in grooves 46 defined in two end plates 48 (only the rear end plate shown on FIG. 1) fixedly attached to the outside surfaces of housing 22.

Defined in housing 22 are two exhaust chambers 60 (FIG. 1) which communicate between the inner periphery of the housing and an external exhaust system (not shown) and two intake chambers 62 which communicate between the inner periphery of the housing and an external source of air and fuel (not shown). Also disposed in housing 22 are two spark plug nodes 64, two exhaust valve lifts 66, and two intake valve lifts 68. Disposed at the top of cylinder 40 are an intake valve 80, and exhaust valve 82, and a spark plug 84, the intake and exhaust valves being disposed in rotary block 26 for back-and-forth radial movement therein.

Referring now primarily to FIG. 2, defined around the inner peripheral surface of housing 22 are three parallel grooves 90, 92, and 94, the grooves being so arranged that, when rotary block 26 rotates in the housing, the distal ends of intake valves 80 will ride in groove 94, the distal ends of exhaust valves 82 will ride in groove 90, and the distal ends of spark plugs 84 will ride in groove 92. It will be seen also on FIG. 2, that exhaust valve lifts 66 are disposed in groove 90, intake valve lifts 68 are disposed in groove 94, and spark plug nodes 64 are disposed in groove 92.

Figure 4:
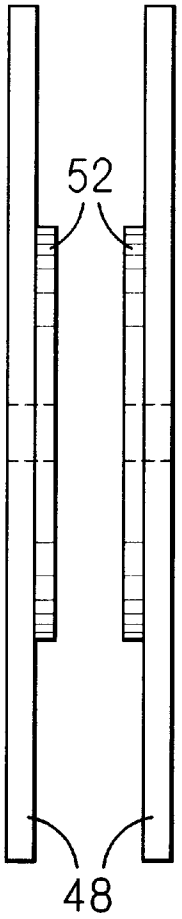
FIG. 4 is an end elevational view of the end plates of the motor.

FIG. 3 illustrates rotary block 26 with one end plate 48 disposed behind the rotary block. It can be seen on this figure that four holes, as at 50, are defined through the corners of end plate 48 for the attachment of the endplate to the rear surface of housing 22 (FIG. 2) by suitable fastening means (not shown). It will be understood that the other end plate 48 will have similar attachment holes defined therethrough. FIG. 4 illustrates side elevational views of end plates 48 each of which end plate includes a raised center portion 52 bearing grooves 46 (FIG. 3), which center portions are disposed within central opening 24 (FIG. 2) when motor 20 is assembled.

Figure 5:
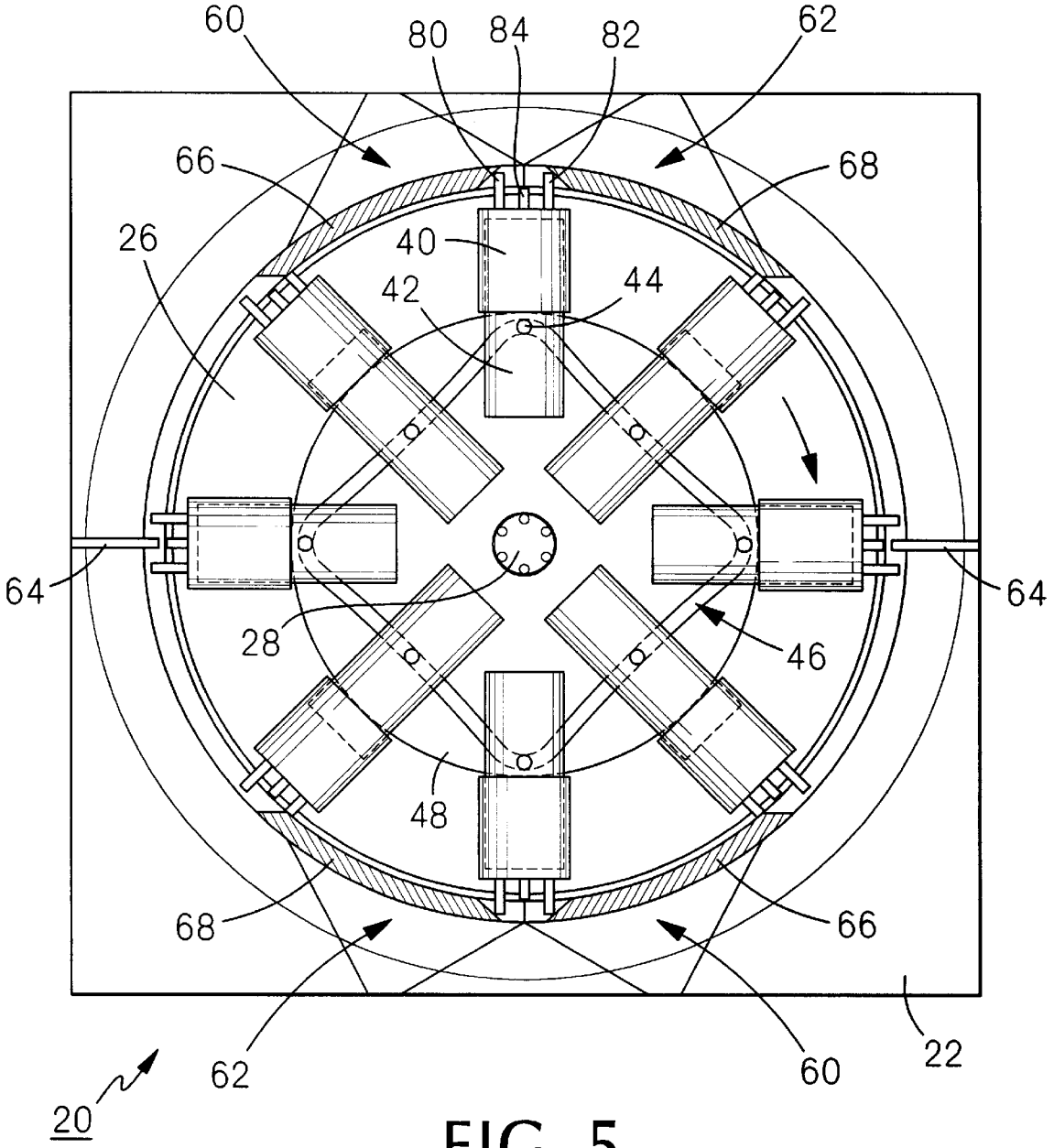
FIG. 5 is an end elevational view, partially cutaway, showing the operation of the motor.

FIG. 5 illustrates the operation of motor 20 as rotary block 26 rotates clockwise in housing 22. When cylinder 40 is in the north, or 0°, position, the exhaust stroke of piston 42 has just been completed and the intake stroke is just beginning, with the piston being drawn down in the cylinder by virtue of the engagement of the ends of piston pin 44 with groove 46. At the same time, the distal end of intake valve 80 is depressed by intake valve lift 68 and air and fuel mixture is drawn into cylinder 40 from intake chamber 62 until the cylinder reaches approximately the 45° position when the distal end of the intake valve no longer engages the intake valve lift. At this point, the compression stroke begins by groove 46 starting to force piston 42 upward in cylinder 40. At the 90° position, the distal end of spark plug 84 comes into proximity with spark plug node 64, the spark plug is energized to ignite the air and fuel mixture in cylinder 40, and the power stoke begins and extends to the 135° position. At approximately this point, the distal end of exhaust valve 80 begins to engage exhaust valve lift 66 and groove 46 begins to force piston 42 upward in cylinder 40, thus expelling exhaust gases out of the cylinder and into exhaust chamber 60. The 180° position is the same as the 0° position and the operation of motor 20 in the next 180° segment of housing 22 is the same as the first 180° degree segment.

Rather than using valve lifts 66 and 68, valves 80 and 82 can be operated by means of solenoids (not shown) which open and close the valves in the proper sequence and at the proper times.

With proper modification (not shown) to the intake and exhaust chambers and to the valves, motor 20 can operate as a two-cycle engine, in which case, a single piston will fire four times per revolution.

Figure 6:
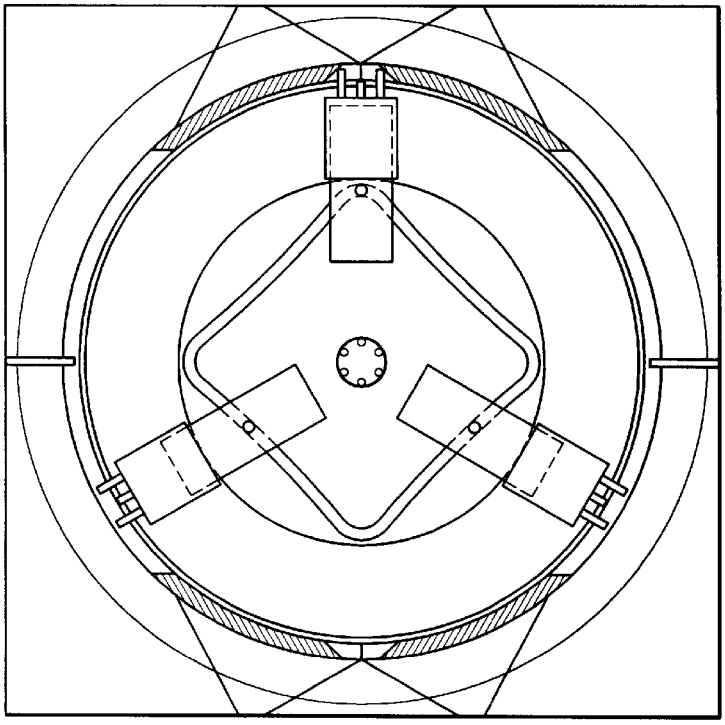
FIG. 6 is an end elevational view, partially cutaway, showing the motor with three cylinders.
Figure 7:
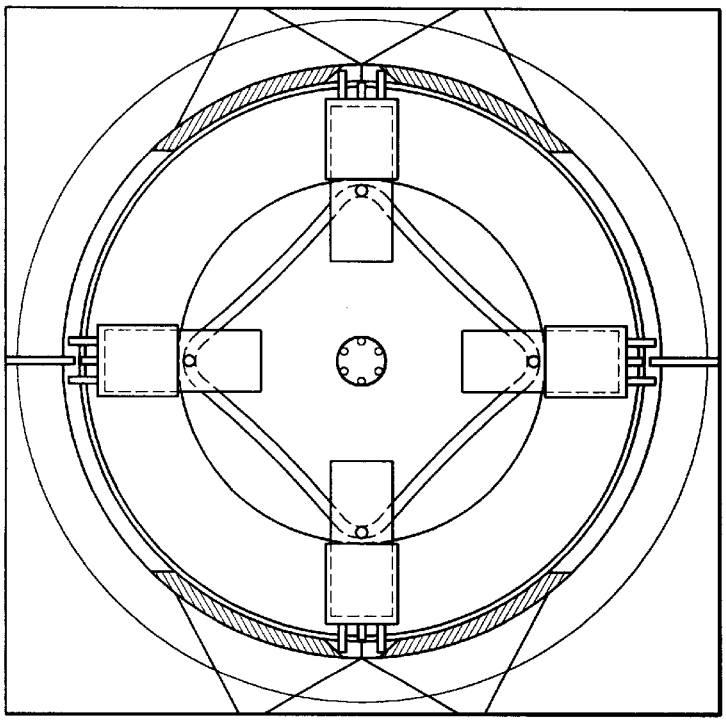
FIG. 7 is an end elevational view, partially cutaway, showing the motor with four cylinders.

Although motor 20 has been described so far with reference to only one cylinder 40, any number of cylinders can be used, limited only by piston diameter, with an odd number of cylinders creating a rapid fire effect and an even number of cylinders resulting in two cylinders firing together. FIG. 6 illustrates a motor having three cylinders and FIG. 7 illustrates a motor having four cylinders.

Figure 8:
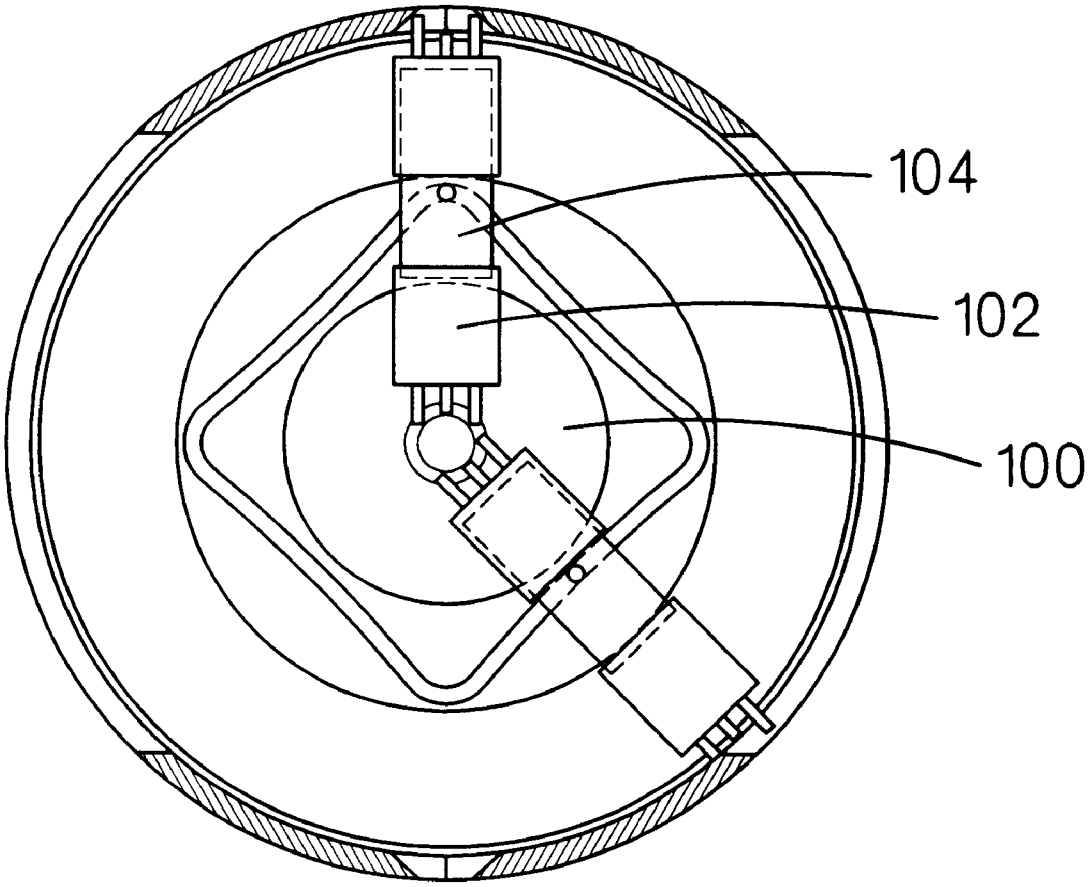
FIG. 8 is an end elevational view, partially cutaway, showing the motor with a single piston and inner and outer rotary blocks, each block containing a cylinder.

FIG. 8 illustrates a motor with a second, inner, rotary block 100, with a second cylinder 102, the motor having a single piston 104, and the figure showing two positions of the piston. In this embodiment, the piston will shuttle between each rotary block, thereby creating twice the power output. In addition, the exhaust chamber for the outer block can be piped to the intake chamber of the inner block which will mean that the fuel will be more completely burned, resulting in much lower engine emissions.

It will be understood that, with minor modifications known to those having ordinary skill in the art, the motor of the present invention can be provided as a diesel engine.

Figure 9:
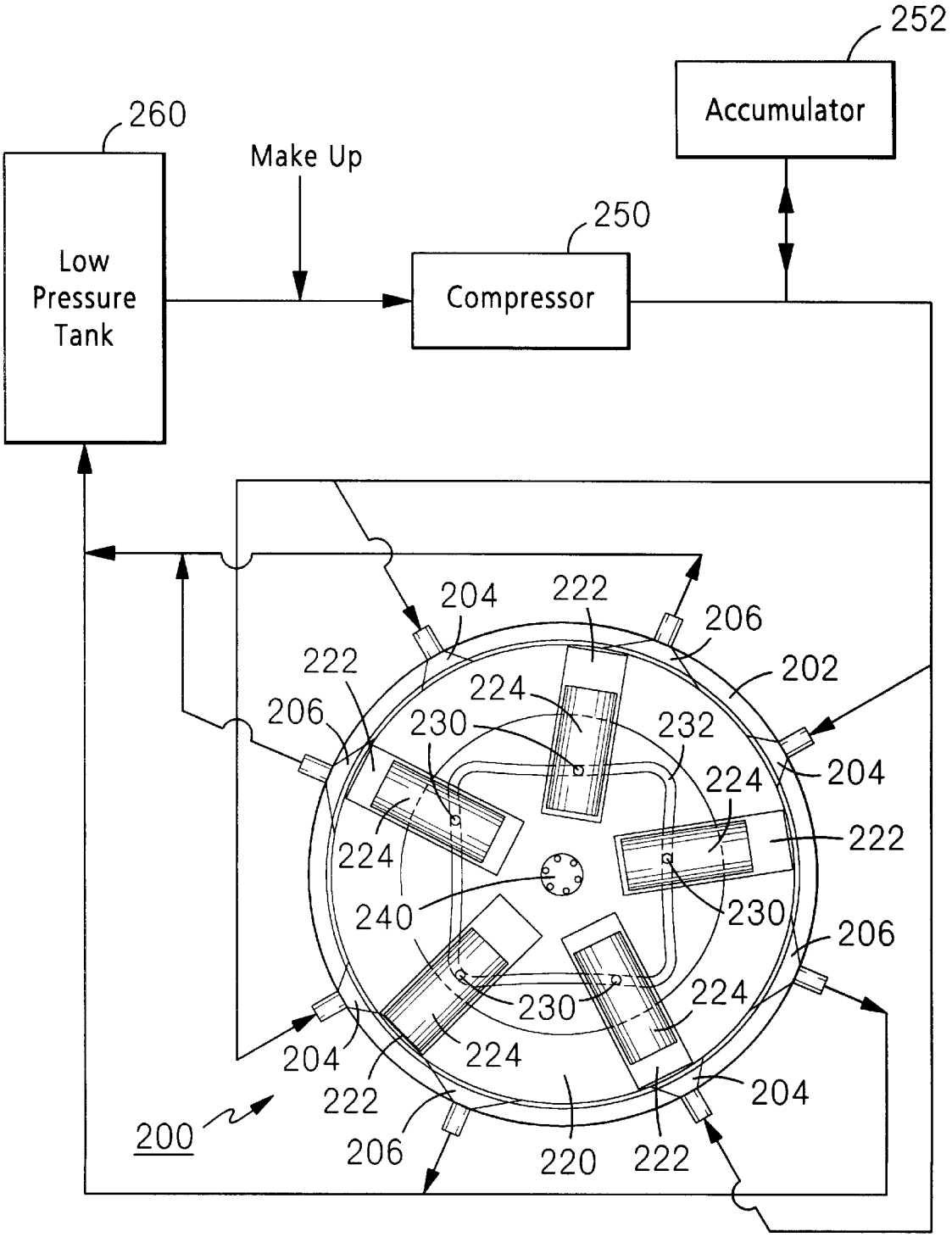
FIG. 9 is a block diagram, with a motor of the present shown in a fragmentary end elevational view, of a system in which the motor is powered by compressed gas.

FIG. 9 illustrates a motor, generally indicated by the reference numeral 200, constructed according to another embodiment of the present invention.

Motor 200 includes an annular housing 202 having defined therein four inlet chambers 204 and four outlet chambers 206. Disposed circumjacently internally of housing 202 is an annular rotary block 220 having defined therein five cylinders 222 in which five pistons 224 are disposed for reciprocating motion with respect thereto. Each piston 224 has a piston pin 230 extending through the walls thereof, with the ends of the piston pin inserted into grooves 232 defined in end plates 234 (only the rear end plate shown) which are fixedly attached to the front and back surfaces of motor 200. Rotary block 220 is operatively attached to an output shaft 240.

It will be seen that the construction of motor 200 is similar to that of motor 20 (FIG. 5). The operation of motor 200 is quite different from that of motor 20, in that motor 200 is powered by compressed gas. The gas may be any suitable gas, but is preferably air. A compressor 250 is connected to inlet chambers 204 to supply compressed gas thereto, with an accumulator 252 connected between the compressor and inlet chambers 204 to smooth out fluctuations in pressure of the gas. Cylinders 222 receive compressed gas when at least partially aligned with inlet chambers 204 and the compressed gas is expelled from the cylinders by pistons 224 when the cylinders are at least partially aligned with outlet chambers 206. One of cylinders 222 is always at least partially aligned with an inlet chamber 204 to accept compressed gas and thereby create movement of rotary block 220.

When cylinders 222 are at least partially aligned with outlet chambers 206, pistons 224 force air out of the cylinders and to a low pressure tank 260 from which compressor 250 takes suction. Because of inefficiencies in the system, a makeup gas source is provided at the inlet to compressor 250 to provide makeup gas when the flow from low pressure tank 260 is insufficient.

A particular advantage of motor 200 is that no valves are required, since rotary block 220 seals the inner end of any of inlet chambers 204 and outlet chambers 204 whenever a cylinder 222 is not aligned therewith.

It will thus be seen that the objects set forth above, among those elucidated in, or made apparent from, the preceding description, are efficiently attained and, since certain changes may be made in the above construction without departing from the scope of the invention, it is intended that all matter contained in the above description or shown on the accompanying drawing figures shall be interpreted as illustrative only and not in a limiting sense.

It is also to be understood that the following claims are intended to cover all of the generic and specific features of the invention herein described and all statements of the scope of the invention which, as a matter of language, might be said to fall therebetween.

I claim:

1. An engine, comprising:

(a) a housing having a cylindrical inner surface;

(b) a first circular block rotatably disposed within said housing and coaxial therewith, said first circular block having its outer surface circumjacent said inner surface;

(c) at least one first cylinder radially defined in said first circular block, said at least one first cylinder having its upper, closed end disposed at said outer surface;

(d) at least one piston disposed in said at least one first cylinder for reciprocating motion therein;

(e) at least two inlet chambers defined in said housing and connected to a source of inlet gas to introduce inlet gas into said at least one first cylinder as said at least one first cylinder passes one of said at least two inlet, chambers;

(f) at least two outlet chambers defined in said housing to permit outlet gas to exit said at least one first cylinder as said at least one first cylinder passes one of said at least two outlet chambers;

(g) means to cause said first circular block to rotate as a result of a power stroke of said at least one piston;

(h) at least one inlet valve disposed in said first circular block for back-and-forth radial movement therein, rotatable therewith, and selectively openable to permit said inlet gas to enter said at least one cylinder; and (i) at least one outlet valve disposed in said first circular block for back-and-forth radial movement therein, rotatable therewith, and selectively openable to permit said outlet gas to exit said at least one cylinder.

2. An engine, as defined in claim 1, wherein: said means to cause said first circular block to rotate comprises a piston pin extending through walls of said piston, at least one end of said piston pin being inserted in a track defined in an end plate fixedly attached to a side of said housing.

3. An engine, as defined in claim 1, wherein: said first circular block is operatively connected to means to provide output power as said first circular block rotates.

4. A rotary engine, as defined in claim 1, wherein: distal ends of said at least one inlet valve and said at least one outlet valve engage grooves defined in said inner surface of said housing.

5. A rotary engine, as defined in claim 4, further comprising: lifts disposed at selected locations in said grooves to engage said distal ends and to cause said at least one inlet valve and said at least one outlet valve to open as said distal ends pass said lifts as said at least one circular block rotates in said housing.

* * * * *